206-427 SR
10/22/85 XR 4,548,320

United States Patent [19]

Box

[11] Patent Number: 4,548,320

[45] Date of Patent: Oct. 22, 1985

[54] HEAVY-DUTY FULL-DEPTH BEVERAGE CASE

[75] Inventor: Theodor M. Box, Brielle, N.J.

[73] Assignee: Piper Industries of Texas, Inc., Dallas, Tex.

[21] Appl. No.: 165,034

[22] Filed: Jul. 1, 1980

[51] Int. Cl.[4] ..... B65D 21/02; B65D 1/42

[52] U.S. Cl. ..... 206/509; 220/21; 220/72; 206/427

[58] Field of Search ..... 220/21, 72, DIG. 15; 206/427, 503, 509

[56] References Cited

U.S. PATENT DOCUMENTS

| | | | |
|---|---|---|---|
| 3,428,206 | 2/1969 | Schoeller | 220/21 |
| 3,628,684 | 12/1971 | Sere | 220/21 |
| 3,655,088 | 4/1972 | Box | 206/427 |
| 3,809,279 | 5/1974 | Arjas | 220/21 |

FOREIGN PATENT DOCUMENTS

| | | | |
|---|---|---|---|
| 2213149 | 9/1972 | Fed. Rep. of Germany | 220/21 |
| 1507345 | 11/1967 | France | 220/21 |
| 1537119 | 7/1968 | France | 220/72 |
| 1553111 | 12/1968 | France | 220/21 |
| 1096184 | 11/1967 | United Kingdom | 206/509 |
| 1129480 | 10/1968 | United Kingdom | 220/21 |

*Primary Examiner*—George E. Lowrance
*Attorney, Agent, or Firm*—Mason, Fenwick & Lawrence

[57] ABSTRACT

A heavy-duty plastic molded single-cell beverage case provided with a plurality of columnar support members extending from the upper stacking rim to the bottom of the case for transmitting and withstanding high compressive stacking forces, the support members defined by a ribbed structure. A plurality of horizontal ribs, an upper rectangular panel and triangular gusset plates disposed at the junction of the columnar members and said panel enhance the structual rigidity and strength of the case.

9 Claims, 17 Drawing Figures

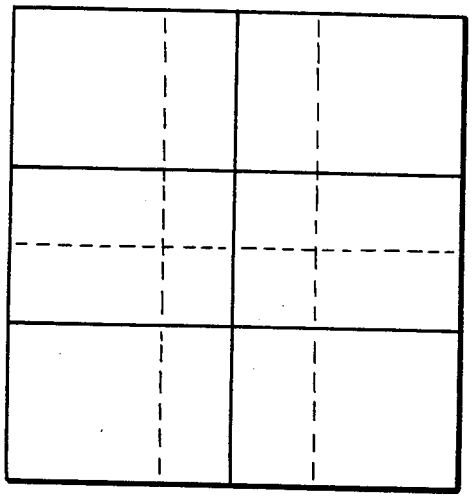
Fig. 10.
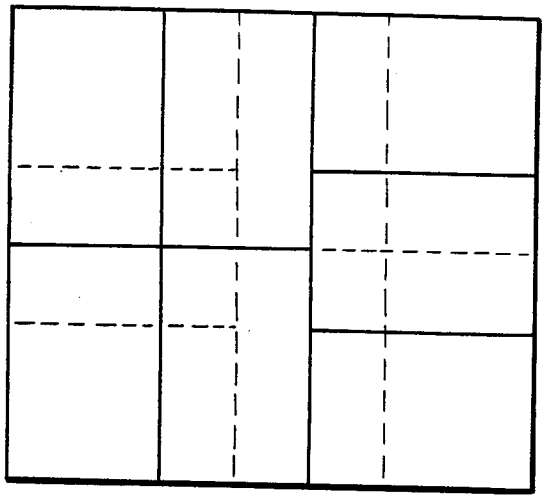
Fig. 11.
Fig. 16.
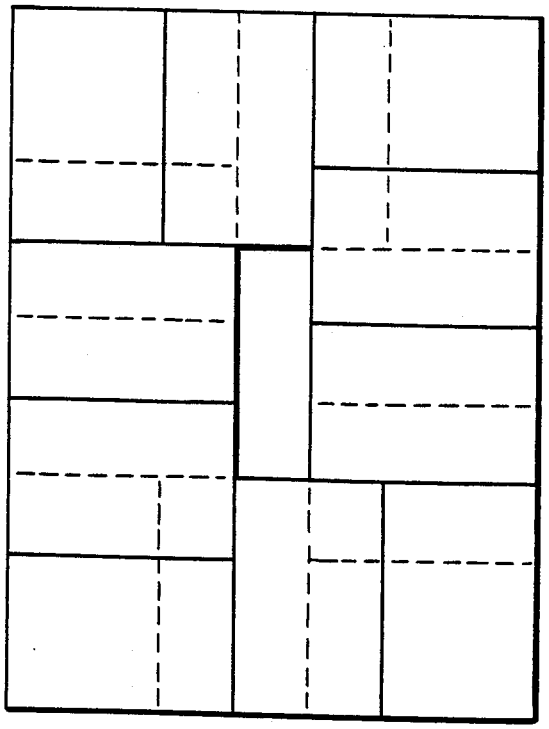
Fig. 17.
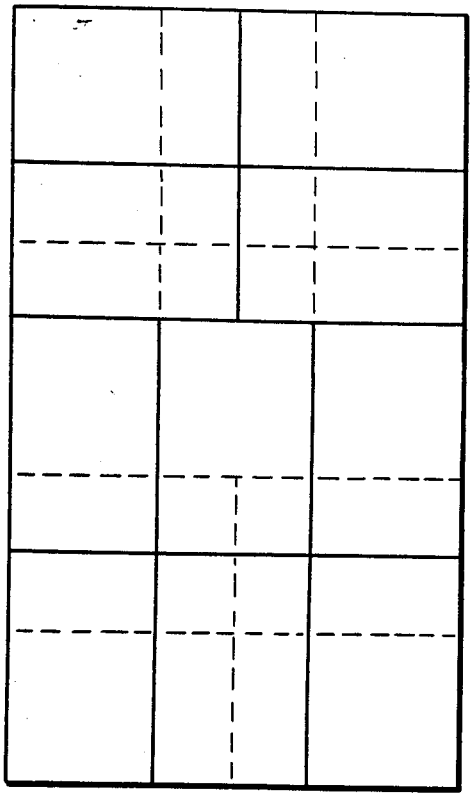

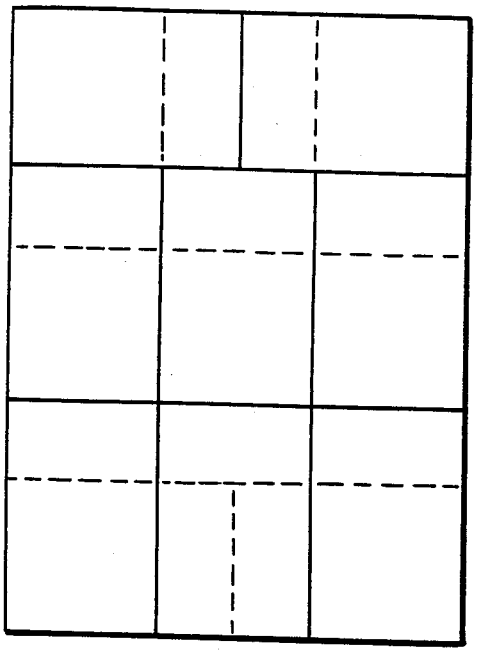
Fig. 12.
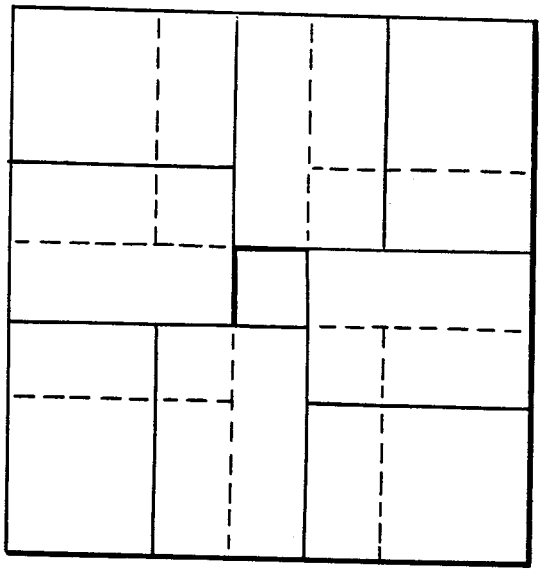
Fig. 13.
Fig. 14.
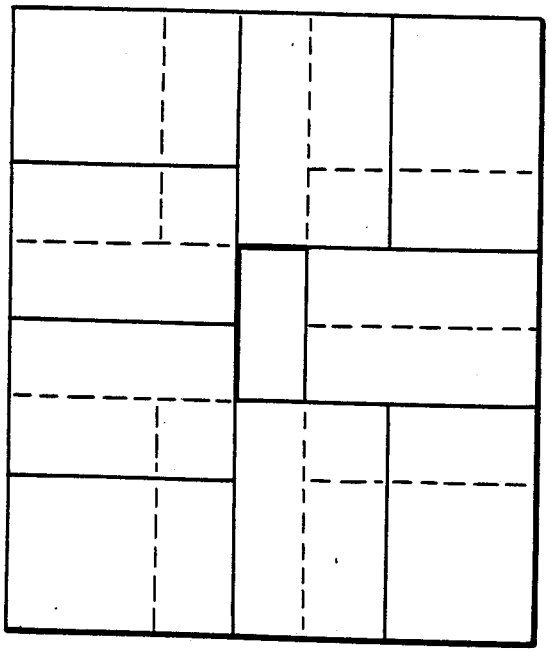
Fig. 15.
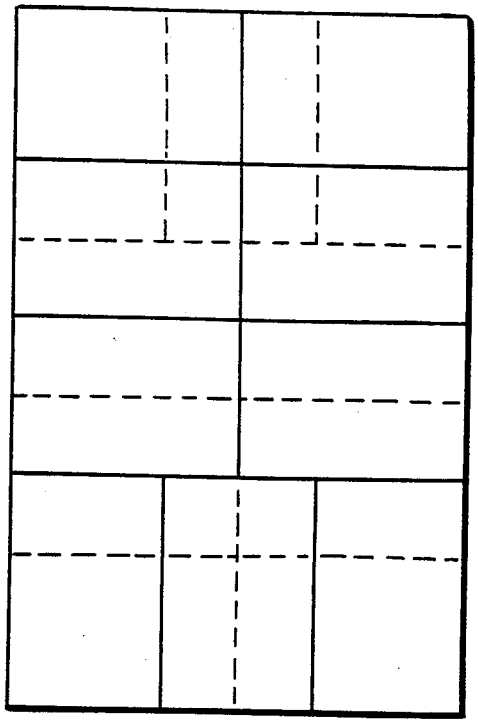

HEAVY-DUTY FULL-DEPTH BEVERAGE CASE

BACKGROUND OF THE INVENTION

Plastic molded rectangular full-depth beverage cases are known in the art. U.S. Pat. No. 3,186,586 discloses one such single-cell case designed by the present inventor particularly adapted for transporting milk cartons. Another case dislosed in U.S. Pat. No. 3,998,328 was for a strengthened full-depth case having vertical strengthening ribs and triangular cross-section column members at the corners to enhance the strength of the case which also was aided by the inner compartmentation of the case.

There has been a long standing need, however, for a full-depth single-cell plastic molded beverage case for transporting heavy fluid containers, e.g., two liter beverage bottles, that would have structural strength and dimensional stability under substantial stacking loads. Prior experience has shown that such cases were incapable of continued use under heavy-duty service and either outright breakage or at least severe distortion under heaving loading forces would severely shorten the service life of such a case.

Thus it is an object of the present invention to provide a heavy-duty single-cell plastic molded beverage case with such structural strength and rigidity that it can support fully loaded two liter beverage bottles with the capability of cross-tying five cases high in a vertical stack of three pallets, i.e., a total stack comprising fifteen layers of cases.

BRIEF SUMMARY OF THE INVENTION

The beverage case according to the principles of the present invention is comprised of a plurality of vertical columns extending from top to bottom of the case, each having a pair of outwardly projecting rib members. There is one such column member at each of the four corners of the case, one in the middle of each endwall and two intermediate the ends of each sidewall, each of the columns, except for those at the corners, having corresponding pairs of vertical ribs on the interior of the case. There is an upper horizontal panel extending around the upper part of the case and triangular gussets are disposed at the junction of the vertical columns with said panel on the sidewalls There is a lower horizontal panel extending around the case adjacent the bottom and triangular gussets are disposed at the junction of the vertical columns with said lower panel. Centrally disposed bearing pads on the upper edge of the endwalls contribute to the structural strength, the entire design providing for transmission of compressive forces directly from the upper stacking rim to the bottom of the case when under stacking pressure. Circular pads are mounted on the interior surface of a bottom lattice network and spaced rectangular stacking ribs on the outer bottom provide cross-tying stabilizers.

DESCRIPTION OF THE DRAWINGS

FIG. 10 is a schematic plan view of cases stacked in a 6×6 criss-cross relation;

FIG. 11 is a schematic plan view of a 7×7 criss-cross stacking arrangement;

FIG. 12 is a schematic plan view of an 8×8 criss-cross stacking relationship;

FIG. 13 is another 8×8 stacking arrangement;

FIG. 14 is a 9×9 stacking schematic;

FIG. 15 is another 9×9 stacking schematic;

FIG. 16 shows a 10×10 stacking schematic; and

FIG. 17 shows another 10×10 stacking schematic.

DETAILED DESCRIPTION

Figure 1:
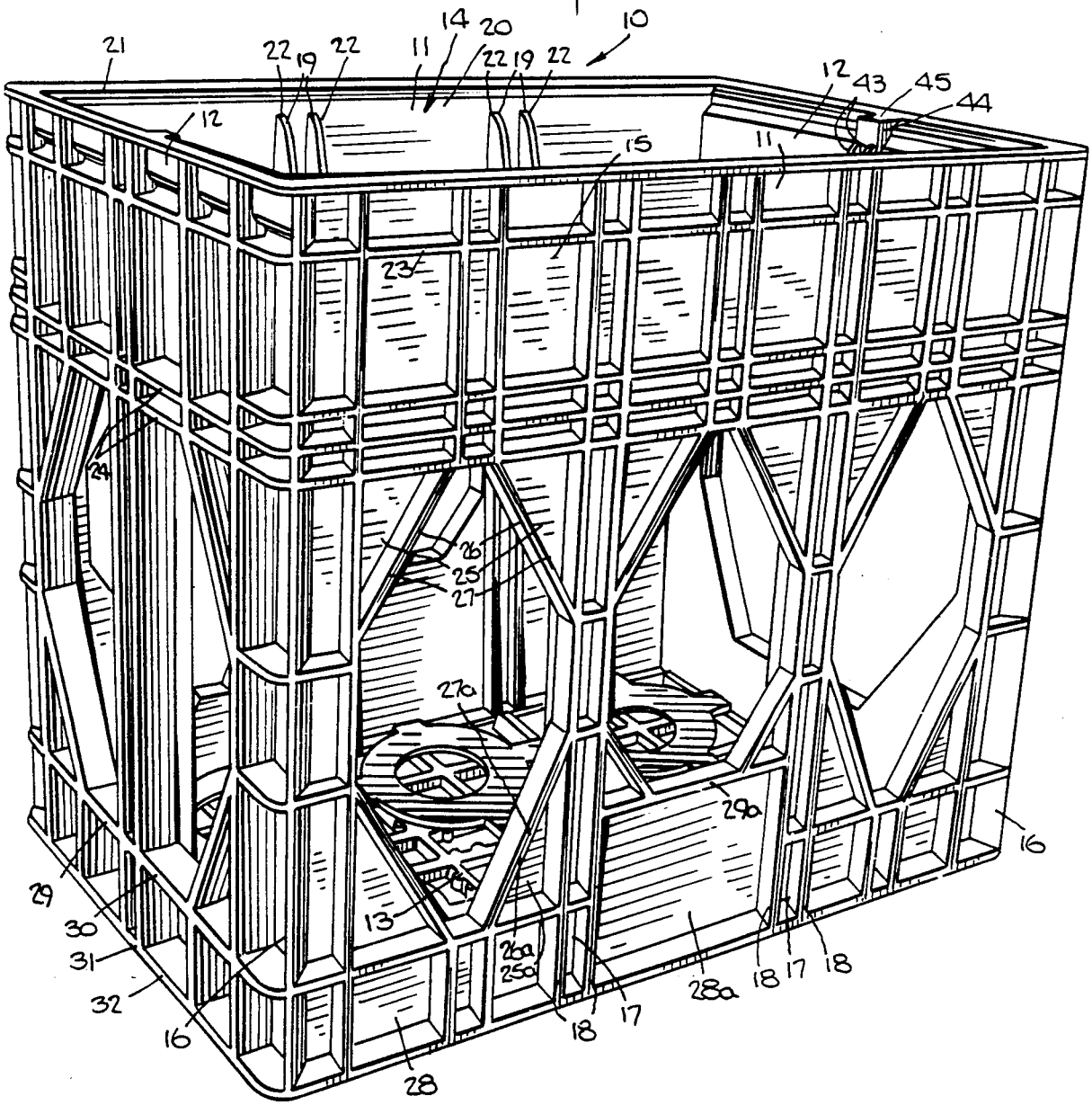
FIG. 1 is an isometric view of one embodiment of the beverage case according to the principles of the present invention.

Referring now to the drawings, the respective elements of the case having the same reference numerals in the various views, particularly FIG. 1, the case is designated generally by reference numeral 10 and has a pair of sidewalls 11 and a pair of endwalls 12 and bottom 13, with an open top 14. The case has no inner compartmentation and is particularly adapted for receiving six two liter plastic beverage bottles of either of the two present commercial types, i.e., with a flat bottom or with small projecting bottom bosses (neither shown). The upper portions of the sidewalls and endwalls are constituted by a rectangular panel 15 that extends around the entire upper portion of the case.

Each sidewall 11 has a pair of end vertical column members 16 and a pair of intermediate column members 17 each having outwardly extending rib members 18 disposed along the respective outer edges of each column from the bottom to the top of the case. Each intermediate column member 17 has corresponding inwardly extending vertical rib members 19 disposed along the interior 20 of the case from the bottom adjacent the upper stacking rim 21 and having tapered upper ends 22. Extending around the sidewalls and endwalls of the case is an outwardly projecting horizontal rim 23 disposed adjacent, but spaced from upper stacking rim 21 and intersecting the respective ribs 18. An additional pair of similar horizontal rib members 24 are disposed adjacent the bottom edge of panel 15.

Figure 5:
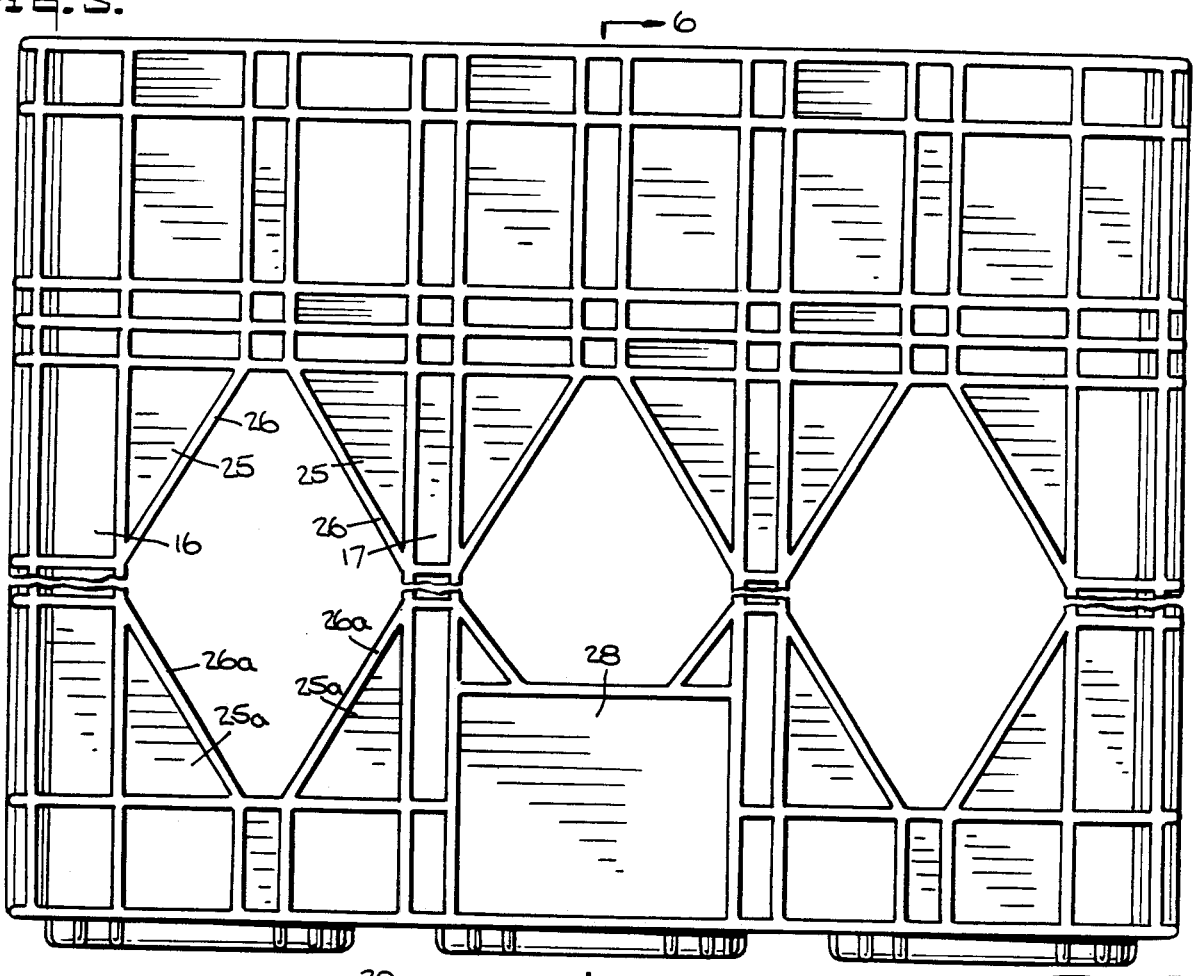
FIG. 5 is a fragmentary side elevation.
Figure 7:
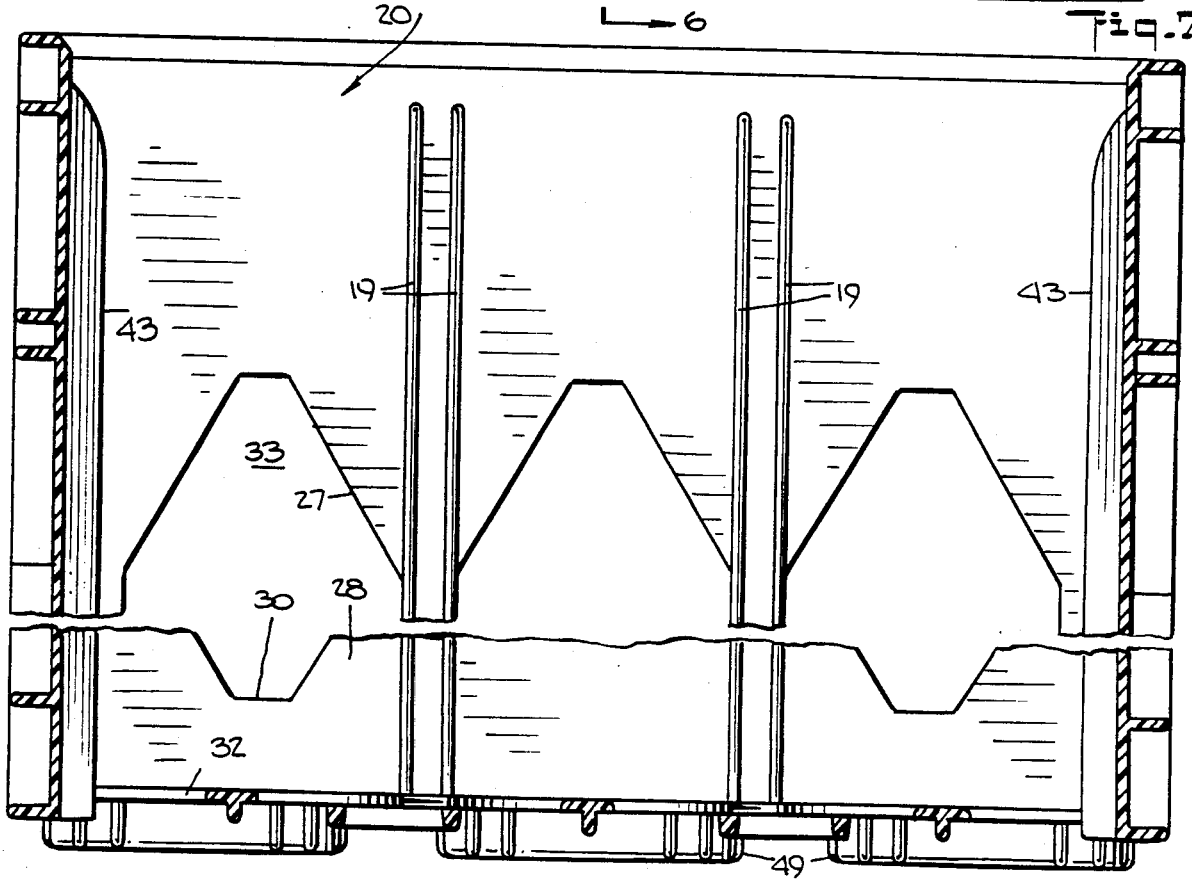
FIG. 7 is a fragmentary section taken along lines 7—7 of FIG. 4.

Triangular gusset plates 25 are formed adjacent the merger of the vertical column members 16, 17 with panel member 15 (see FIG. 5) and have outwardly projecting diagonal rib members 26 along the open edges 27 thereof. Each sidewall has a similar horizontal bottom panel member 28 which has outwardly projecting horizontal rib 29 along the upper edge 30 and similar rib member 31 at the bottom 32 thereof. Rib 29 and bottom panel 28 have upwardly disposed portions **29*a* and 28 a respectively extending between column members 16, 17. Similar triangular gusset plates 25*a* are formed adjacent the merger of the vertical column members 16, 17 with bottom panel member 28 and have outwardly projecting diagonal rib members 26*a* along the open edges 27*a* thereof. The upper and lower horizontal panels and gusset plates define polygonal openings 33** in each sidewall which provide visual access to the interior of the case to identify beverage containers located therein during use.

Figure 4:
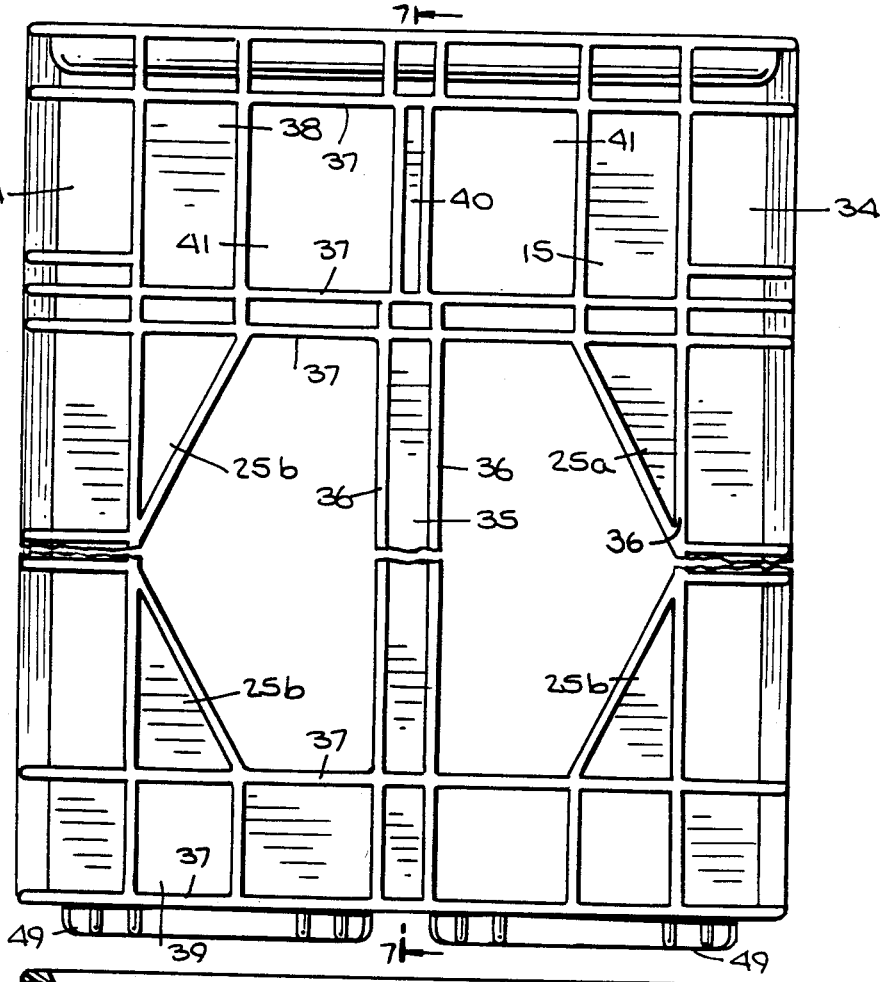
FIG. 4 is a fragmentary end elevation.
Figure 6:
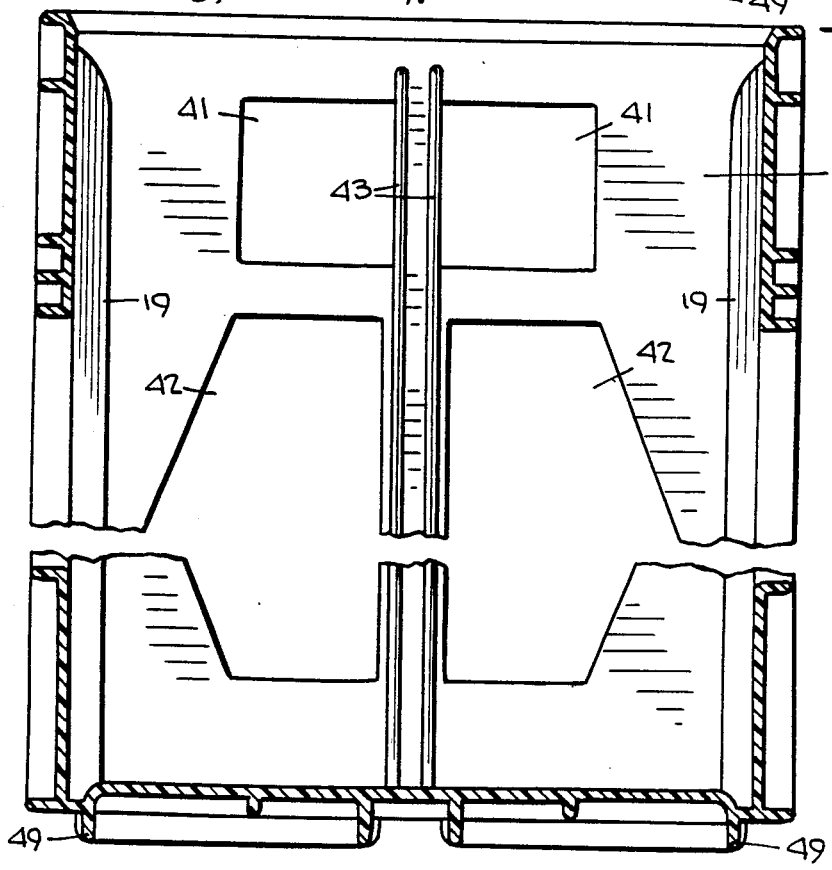
FIG. 6 is a fragmentary section taken along lines 6—6 of FIG. 5.

Each endwall has similarly constructed vertical column members 34 and a central column member 35 (see FIG. 4) with associated vertical rib members 36 and horizontal rib members 37 and upper and lower horizontal panels 38, 39 respectively. The central vertical column member 35 has an upper extension 40 extending through and bisecting hand hole 41 as shown. The lower portion of each endwall has access openings 42. Column member 35 has corresponding inner vertical ribs 43 disposed on the interior of the case similar to the inner vertical ribs 19 of the sidewalls previously described. At the upper end of the inner vertical ribs 43 is disposed a bearing block 44 having an upper rectangular flat surface 45 (see FIG. 1) coplanar with the stacking rim 21 to provide additional stacking support for cases in criss-cross relation. Triangular gusset plates **25*b* interconnect vertical column members 16 with upper and lower horizontal panels 15 and 28** respectively.

Figure 2:
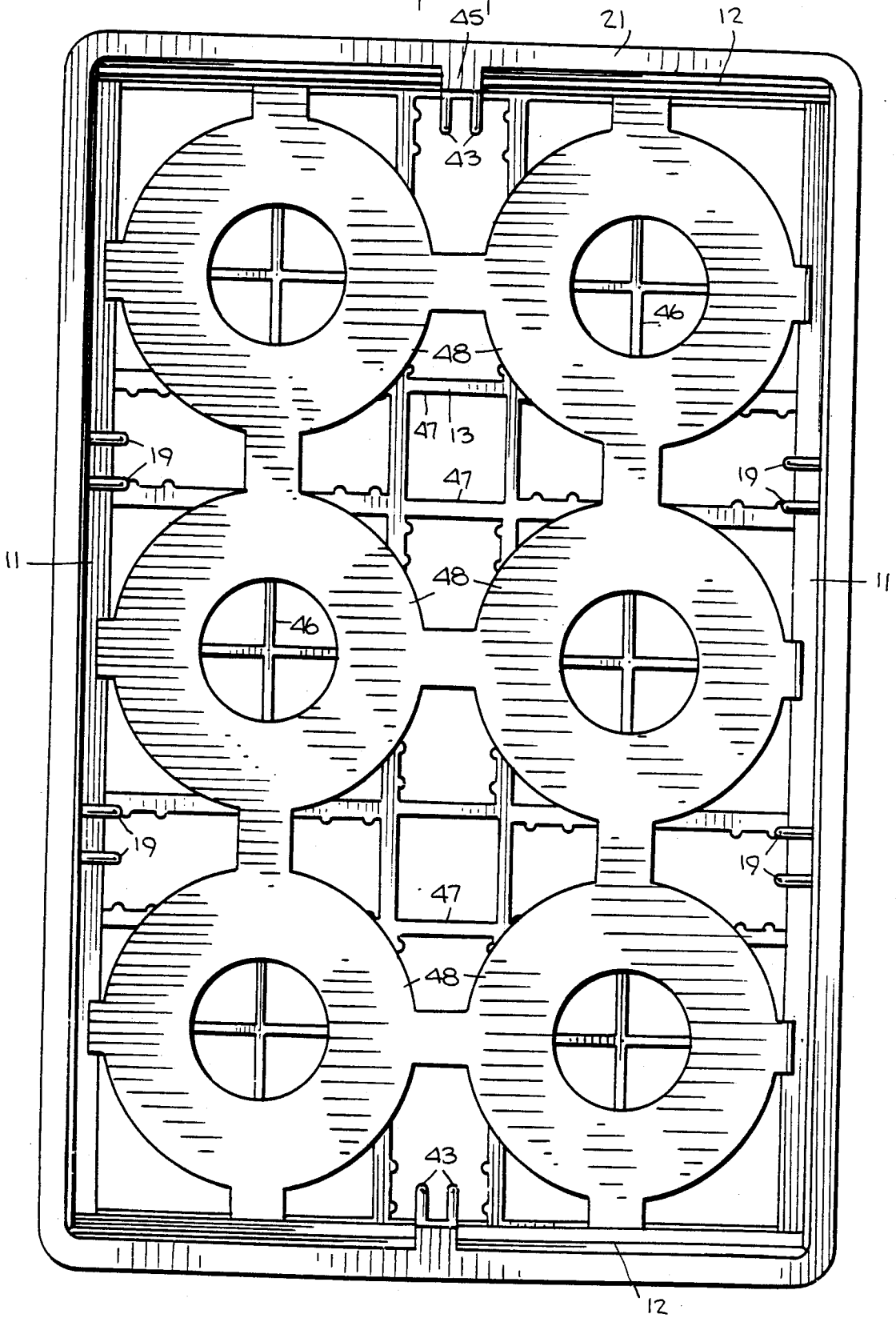
FIG. 2 is an enlarged top plan view of the case.
Figure 3:
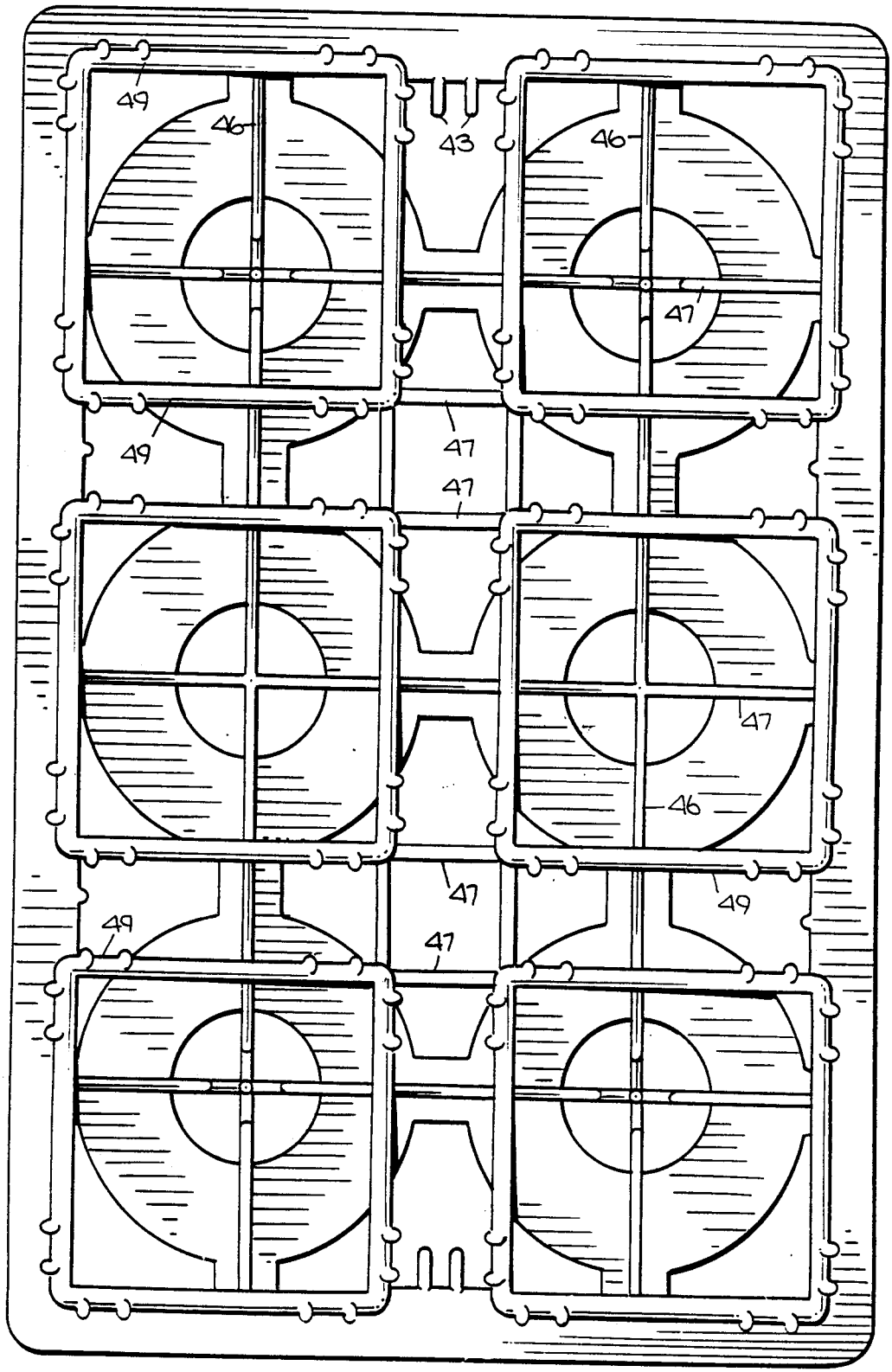
FIG. 3 is an enlarged bottom plan view of the case.
Figure 8:
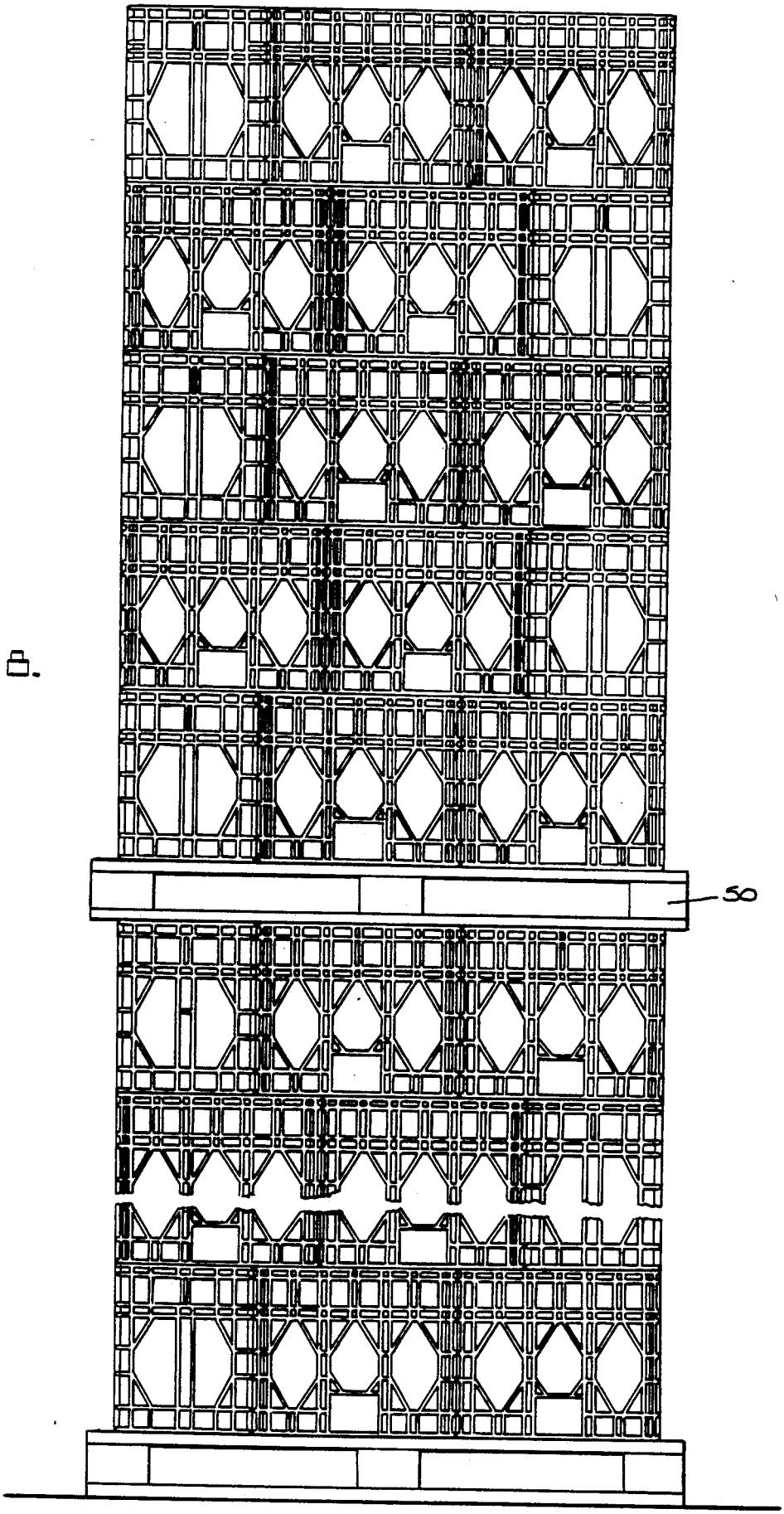
FIG. 8 is a fragmentary schematic showing a general stacking configuration of a series of palletized cases.
Figure 9:
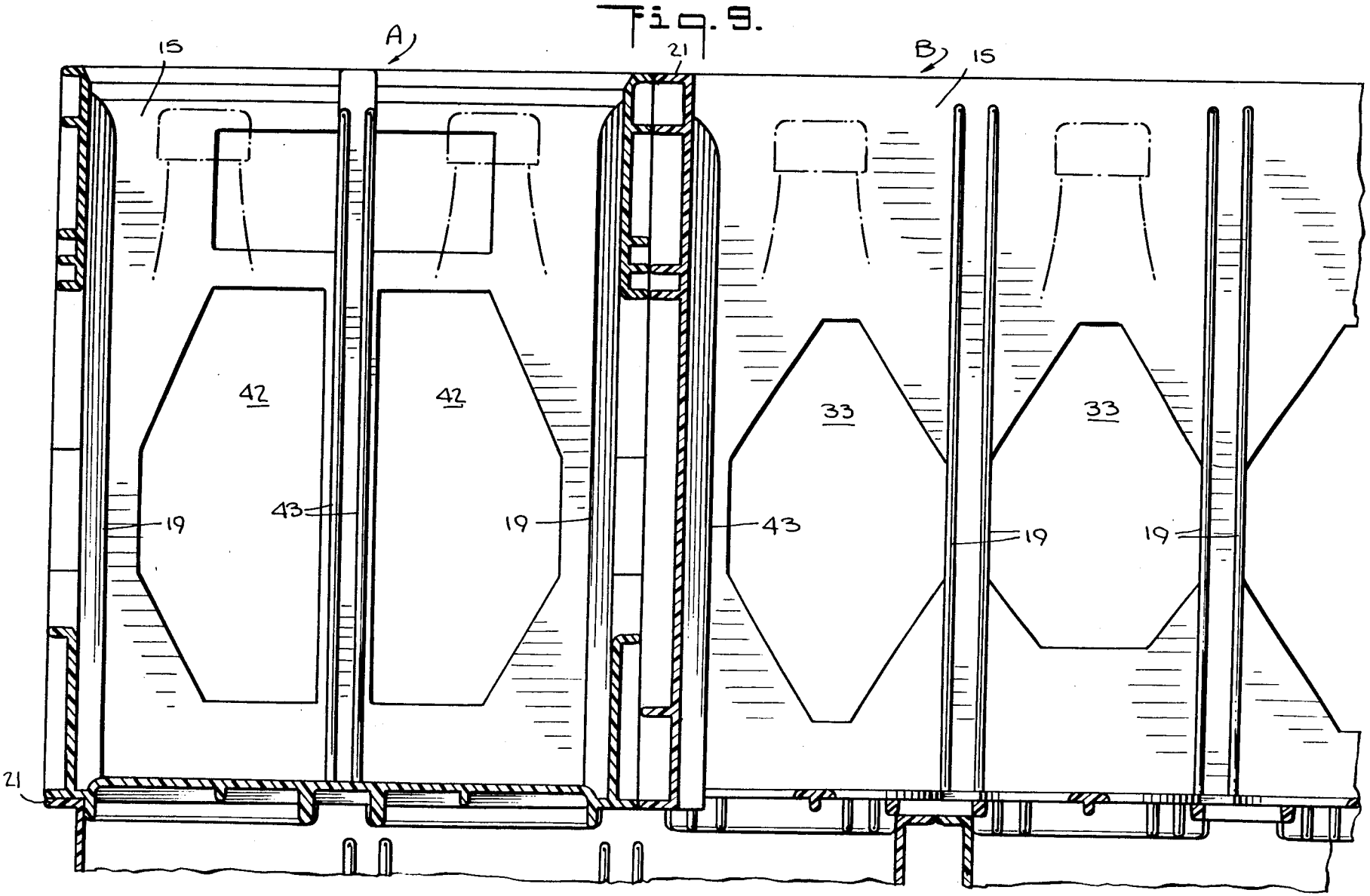
FIG. 9 is a fragmentary schematic showing sectional portions of four cases in cross-tied relationship.

Referring to FIGS. 2 and 3, the case bottom is comprised of a rectangular lattice work defined by longitudinal ribs 46 and horizontal ribs 47. The inner bottom of the case has a plurality of open circular flat disc members 48 contiguous with the lattice work and adapted to receive the bottoms of beverage containers or bottles. On the outer bottom of said lattice work are disposed a plurality of rectangular rib configurations 49 adapted for aligned and/or criss-cross palletizing of similar cases one upon the other in a well-known manner. FIG. 8 is a fragmentary view showing the general arrangement of the stacking of palletized cases. Upper pallet 50 is shown with five layers of stacked cases in criss-cross fashion and the structural strength of the cases according to the present invention permits the stacking of three sets of five high palletized cases to be stacked one upon the other. Referring to FIG. 9, the stacking relationship of portions of four cases is shown in an 8×8 stacking assembly as depicted in FIG. 12. The cases would be those designated A and B in solid lines and C and D in dotted lines in FIG. 12, and having the same letter designation in FIG. 9.

The various configurations of criss-cross palletizing from 6×6 up to 10×10 are shown in the schematic diagrams FIGS. 10 through 17.

As is well known in the art, the case can be constructed of any conventional molded high-impact strength plastic material such as high-density polyethylene, polypropylene and the like. It has been found with the present design that the case will support 5,000 pounds on a criss-cross system of stacking while maintaining structural rigidity and dimensional stability which is achieved by the novel vertical column arrangement.

While one embodiment of the invention has been shown and described, it is to be understood that changes and additions may be made by those skilled in the art without departing from the scope and spirit of the invention.

What is claimed is:

1. A heavy-duty unitary plastic molded full-depth beverage case comprising pairs of side and endwalls and a bottom, the top of said case having an outwardly projecting stacking rim extending around the case, a similar lower rib member disposed adjacent said rim, an upper panel on each sidewall extending downwardly from said top and terminating in a lower edge at an intermediate point, a plurality of pairs of vertical ribs disposed along each panel from said rim to said lower edge, a pair of horizontal ribs disposed around said case adjacent said lower edge, alternate pairs of said vertical ribs extending from top to bottom of said case to define structural columns for transmitting compressive stresses through the case in a stacked configuration with other similar cases and angular gusset plates formed at the juncture of said structural columns with said panel, each plate having an outwardly projecting rib along its angular edge merging with adjacent vertical ribs.

2. In the case of claim 1, a lower horizontal panel abutting the bottom edge of each sidewall and endwall and extending from end to end thereof, and respective horizontal outwardly projecting ribs along the upper and lower edges of each said lower panel.

3. In the case of claim 2, angular gusset plates formed at the juncture of said structural columns with said lower horizontal panel, each plate having an outwardly projecting rib along its angular edge merging with adjacent vertical and horizontal ribs.

4. In the case of claim 3, said gusset plates and structural columns defining polygonal openings in said sidewalls.

5. In the case of claim 3, each said endwall including a plurality of pairs of horizontal and vertical ribs defining an end and central vertical columnar structure and further defining a pair of vertically extending rectangular openings extending upwardly from said horizontal panel and terminating at an intermediate point.

6. In the case of claim 5, each endwall having a centrally disposed rectangular rib structure adjacent its upper edge defining a hand hole, an extension of each said central vertical columnar structure disposed through each said hand hole to the upper stacking rim of said case.

7. In the case of claim 6, a respective pair of inner vertical rib members disposed in the interior of said case adjacent and coextensive with each said structural column, the upper ends of said rib members curving into said upper stacking rim, and bearing block members disposed at the upper ends of the inner vertical rib members on said endwalls, said block members having rectangular flat upper surfaces coplanar with said rim.

8. In the case of claim 7, said bottom comprised of longitudinal and transverse ribs defining a rectangular lattice support network, a plurality of open center circular disc members disposed on said network to form inner bottom bottle supports.

9. In the case of claim 8, a plurality of spaced, downwardly projecting rectangular ribs on the outer bottom of said network to provide a stacking stabilizing structure.

* * * * *